United States Patent [19]

Wetter et al.

[11] 4,294,415

[45] Oct. 13, 1981

[54] CUTTER KNIFE

[75] Inventors: Manfred Wetter, Biedenkopf-Breidenstein; Karl H. Schmidt, Steffenberg-Quotshausen, both of Fed. Rep. of Germany

[73] Assignee: Kraemer & Grebe GmbH & Co. KG Maschinen- und Modellfabrik, Biedenkopf-Wallau, Fed. Rep. of Germany

[21] Appl. No.: 65,038

[22] Filed: Aug. 9, 1979

[30] Foreign Application Priority Data

Aug. 22, 1978 [DE] Fed. Rep. of Germany ..... 2836630

[51] Int. Cl.[3] ..... B02C 18/18

[52] U.S. Cl. ..... 241/292; 241/292.1

[58] Field of Search ..... 241/282.1, 282.2, 292, 241/292.1; 83/591, 663

[56] References Cited

U.S. PATENT DOCUMENTS

| | | | |
|---|---|---|---|
| 192,454 | 6/1877 | Read | 241/292 |
| 197,023 | 11/1877 | Ent | 241/292 |
| 1,314,575 | 9/1919 | Davidson | 241/292 X |
| 2,721,593 | 10/1955 | Schaller | 241/282.2 X |
| 3,141,485 | 7/1964 | Bonner, Jr. et al. | 241/292 X |
| 3,330,317 | 7/1967 | Schaller | 241/282.2 |
| 3,631,907 | 1/1972 | Laska | 241/292.1 |
| 3,730,363 | 5/1973 | Karpf | 241/282.1 |
| 3,897,020 | 7/1975 | Knecht | 241/292.1 |
| 3,937,408 | 2/1976 | Buck | 241/292.1 X |
| 4,211,371 | 7/1980 | Hotimsky | 241/292 X |

FOREIGN PATENT DOCUMENTS

| | | | |
|---|---|---|---|
| 2703663 | 8/1978 | Fed. Rep. of Germany | 241/292.1 |

*Primary Examiner*—Howard N. Goldberg
*Attorney, Agent, or Firm*—Blanchard, Flynn, Thiel, Boutell & Tanis

[57] ABSTRACT

A cutter knife assembly for use in a cutting machine. The cutter knife has an opening for receiving a cutter spindle therethrough, which opening has a polygon, preferably a hexagon, shape. A stop key is arranged in the opening and on a side thereof which is opposite the location of the cutter blade. A balancing structure is provided in association with the cutter knife, the shape, weight and mounting of which is selected so that the center of gravity of the totality of the cutter knife and the associated balancing structure lies on the axis of the cutter spindle.

12 Claims, 4 Drawing Figures

CUTTER KNIFE

FIELD OF THE INVENTION

The invention relates to a cutter knife with an opening for receiving the cutter spindle, which opening is in the shape of a polygon, preferably in the shape of a hexagon and which is provided with a stop key for the cutter spindle on a side of the opening which is opposite the knife blade.

BACKGROUND OF THE INVENTION

Such cutter knives are inserted in cutter devices, which serve for example to cut up meat. The cutter devices have an annular bowl with an approximate semi-circular cross section and are rotatably driven by a motor. The axis of the cutter spindle is located on the radius centerpoint of the bowl, on which cutter spindle are fastened the cutter knives either directly or through mountings. The cutter knives or their mountings are clamped axially with a spacer and clamping rings and an adjusting nut which is screwed on the cutter spindle. For the rotationally fixed connection of the cutter knives or their mountings to the cutter spindle, the latter is as a rule constructed as a hexagon and the cutter knives or their mountings have corresponding openings.

The cutter knives run with a high peripheral speed closely past the bowl wall and are, therefore, exposed to high centrifugal forces. In the case of oppositely positioned double blade knives, which are constructed S-shaped and have two blades and a form-closed receiving hole for the cutter spindle, the centrifugal forces approximately cancel one another. The double blade knives, however, have the disadvantage that the spacing of the knife blades from the cutter bowl enlarges with every regrinding, so that on the one hand the cutting power is reduced due to the enlarged spacing and on the other hand an unfavorable pulling-in condition results during the cutter operation.

Cutter knives having only one blade, which in addition are secured in a mounting, do not have this disadvantage, however, are more difficult to effect a radial adjustment. Moreover, measures are required to prevent with certainty a radial movement of the knives to the outside due to the large centrifugal force. A further problem in the case of cutter knives having only one blade consists in balancing same statically and dynamically with only a little effort, in order to obtain a vibration-free running of the machine.

The basic purpose of the invention is to provide a cutter knife which can be balanced statically and also dynamically perfectly with a little effort, which does not perform any radial outward movements even at high speeds and thus large centrifugal forces and which is inexpensive to manufacture.

A first embodiment of the invention is characterized by securing at least one balancing disk having an opening for receiving the cutter spindle on the cutter knife in the area of the opening for the cutter spindle, the shape, weight and mounting of which are chosen such that the center of gravity of the totality of the cutter knive and the balancing disk lies on the axis of the cutter spindle.

The cutter knife rests with its stop key, which is constructed in an opening on the cutter spindle and is pressed against same through the radial force which acts onto the cutter knife, so that an undesired radial outward movement toward the bowl wall is prevented.

The center of gravity of the cutter knife and the balancing disk is moved into the axis of the cutter spindle through the balancing disk which is secured on the cutter knife and through which also extends the cutter spindle, so that an extremely vibration-free run of the cutter spindle is obtained. When the cutter spindle is reground, then the correct spacing of the knife blade from the bowl wall is again created by filing the stop key off for the same amount. The regrinding removes mass on the outside on the knife. However, the radial adjustment effects so to speak automatically a maintaining of the center of gravity, since the knife hub, which is large and heavy, moves in direction of the center of the cutter spindle.

The knife hub is constructed preferably larger than would actually be necessary for the fastening, so that the knife hub also without balancing disks already contributes substantially to the balancing effect.

The cutter knife and the balancing disk are preferably adjustable in their position relative to one another, for example by arranging a slotted hole in the balancing disk or in the cutter knife, through which hole extends a screw, through which both parts can be supported through one another.

It has been proven to be particularly preferable to provide the cutter knife with a balancing disk on its two sides. Each balancing disk is preferably provided with tapped holes, into which threaded pins which serve as balancing weights can be screwed. The tapped holes are arranged preferably concentrically with respect to the opening for receiving the cutter spindle on the balancing disk. By screwing in or removing threaded pins, the cutter knife, including the balancing disk, can be dynamically and statically balanced in a simple and quick manner such that the cutter spindle runs vibration-free also at high speeds. Since each cutter knife is balanced statically and dynamically with its balancing disks, each knife adjustment, namely combination of the angular position of all knife units on the cutter spindle, can be realized while maintaining a low vibration machine run. Thus an optimum combination of the cutting tools is possible by using an inventive cutter knife.

To make reworking of the stop key for the cutter spindle easier, markings can be arranged on said cutter spindle, which are spaced from one another approximately at a distance which during a one-time regrinding the cutter knife must be moved with respect to the cutter spindle.

A second embodiment of the invention is characterized by the knife hub, in the region of which is provided the opening for the cutter spindle, having a heavy balancing part, which is arranged approximately diametrically with respect to the knife blade and the shape, position and weight of which are chosen such that the center of gravity of the cutter knife lies on the axis of the cutter spindle.

Separate balancing disks are not provided in this embodiment, but the mass needed for balancing is provided on the knife itself. It is possible both to design in a correspondingly large-surface construction the knife hub equally thick, as the remainder of the knife, or, however, provide a larger thickness at the hub. Also in the case of a one-piece knife, the mentioned tapped holes and the markings can be provided on the stop key body.

BRIEF DESCRIPTION OF THE DRAWINGS

Two exemplary embodiments of the invention will be described in more detail hereinafter with reference to the drawings, in which.

DETAILED DESCRIPTION

Figure 1:
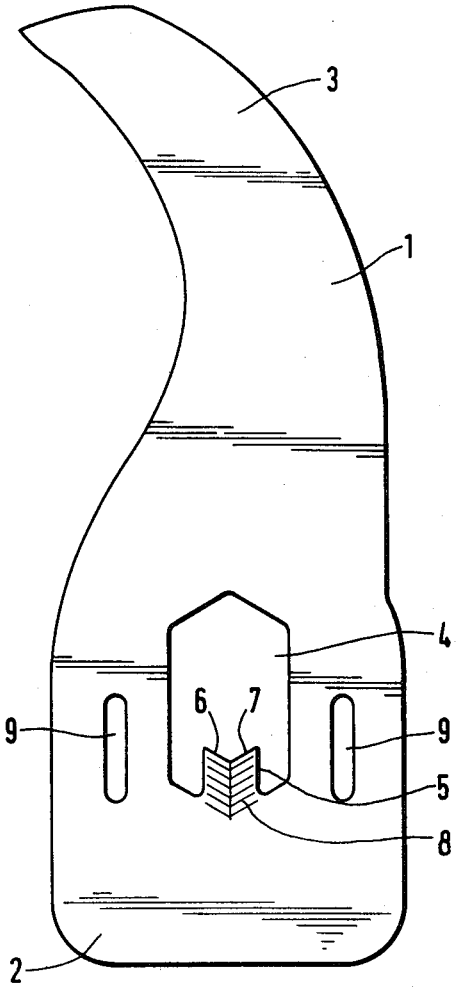
FIG. 1 is a side view of an inventive cutter knife.

The cutter knife 1 which is illustrated in the figures has a hub part 2 and a cutting part 3. A substantially elongated hexagonal slotted hole 4 is provided in the hub part 2, into which slotted hole projects a stop key 5, the two stop surfaces 6 and 7 of which rest on the cutter spindle which is not illustrated and prevent the cutter knife 1 from being movable radially with respect to the cutter spindle.

Markings 8 are provided on the body part of the stop key 5, which markings make finish working of the stop key 5 easier.

Figure 2:
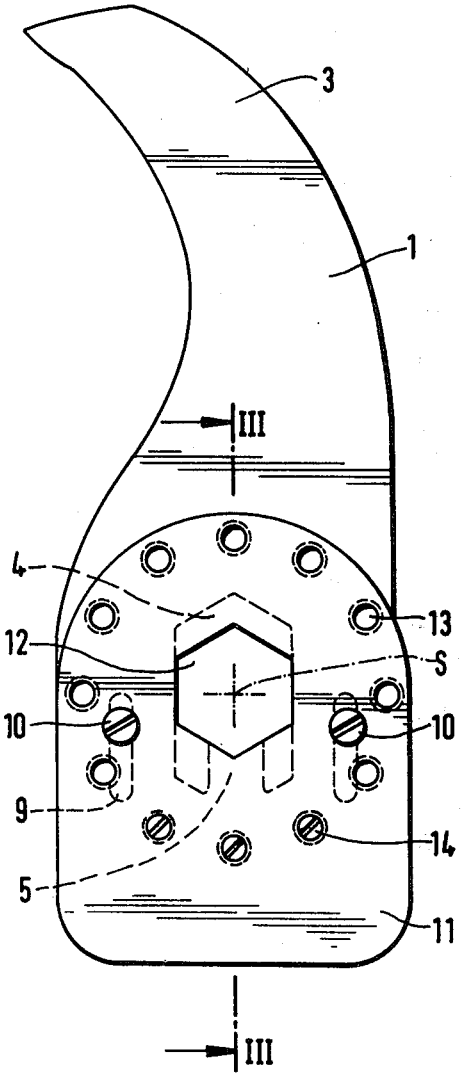
FIG. 2 illustrates the same cutter knife shown in FIG. 1, however, with two balancing disks which are secured on said cutter knife.

Furthermore slotted holes 9 are provided in the hub of the knife 2, through which holes, as can be taken from FIG. 2, extend screws 10. In the region of the hub 2 of the cutter knife 1 there are mounted on the knife on both sides thereof two balancing disks 11, which are held urged against the cutter knife 1 by the screws 10. The balancing disks 11 can be moved relative to the cutter knife 1 an amount which corresponds with the size of the slotted holes 9. This movement is always needed when the cutter knife 1 has been reground and the openings 12 which are provided in the balancing disks must be moved to correspond with the surfaces 6, 7 of the stop key to receive the cutter spindle.

Several tapped holes 13 are provided in each balancing disk 11 concentrically to the opening 12, into which tapped holes 13 threaded pins 14 are screwed to facilitate a balancing of the cutter knife and the balancing disks.

The cutter knife 1 is balanced dynamically and statically together with the two balancing disks 11 which are secured on said knife in such a manner that the center of gravity S will lie on the axis of the cutter spindle. In this manner, a low vibration running of the cutter spindle is possible with the cutter knives being arranged in any desired manner. It has been proven to be particularly preferable to mount two balancing disks on each side of the knife 1, since as a result it can be achieved that the center of gravity S will also lie on the longitudinal axis of the knife. The balancing with the help of the threaded pins 11 requires only a small effort.

Figure 3:
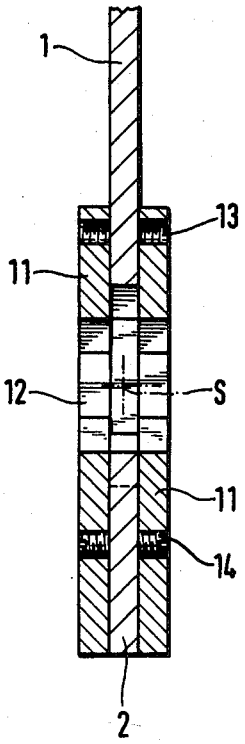
FIG. 3 is a cross-sectional view taken along the line III—III of FIG. 2.
Figure 4:
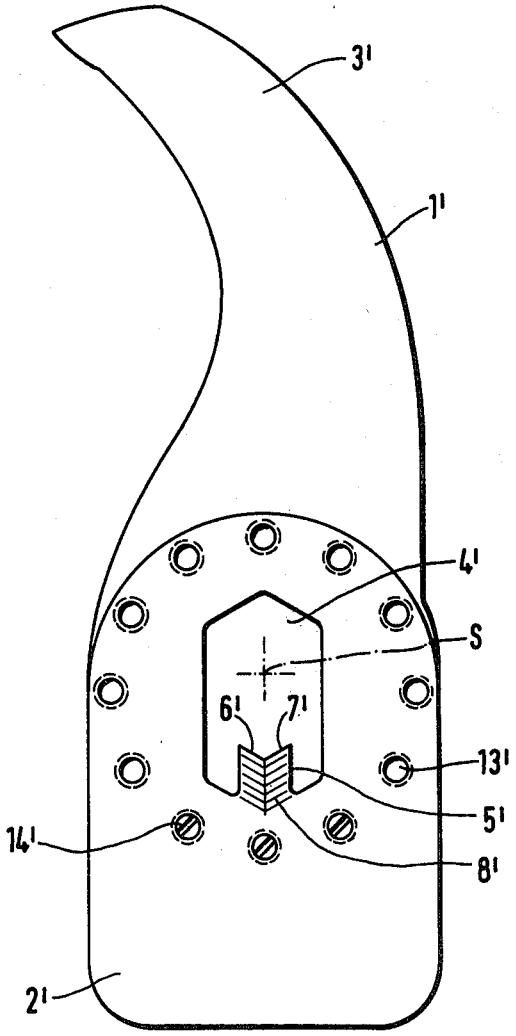
FIG. 4 is a side view of a cutter knife according to a further embodiment of the invention.

In a second embodiment, the knife which is identified by the reference numeral 1' is itself constructed such that the center of gravity of the cutter knife coincides with the axis of the cutter spindle. The tapped holes 13' for the threaded pins 14' are arranged directly in the knife. Slotted holes 9 do not exist in this embodiment. As one will find out during a comparison with the embodiment according to FIGS. 1 to 3, the knife hub 2' according to FIG. 4 is constructed larger than the knife hub 2 according to FIGS. 1 to 3. Moreover, FIG. 4 uses the same reference numerals as FIGS. 1 to 3, however, with a prime suffix added thereto.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In a cutter knife having a knife blade and an opening for receiving a cutter spindle therein, which opening is constructed in the shape of a polygon and having a stop key means for said cutter spindle in a side of said opening which is opposite said knife blade, the improvement comprising at least one balancing disk having an opening therein for receiving said cutter spindle therein and being secured on said cutter knife in the region of said opening for said cutter spindle, the shape, weight and mounting of which are chosen such that the center of gravity of the totality of said cutter knife and balancing disk lies on the axis of said cutter spindle to thereby statically balance said cutter knife, said cutter knife further including dynamic balancing means for facilitating a dynamic balancing of said cutter knife.

2. The cutter knife according to claim 1, wherein a cutter hub is provided, in the region of which said opening for said cutter spindle is provided, said cutter hub having a heavy part arranged approximately diametrically opposite to said knife blade and for effecting a location of the center of gravity close to said cutter spindle axis to facilitate said static balancing of said cutter knife.

3. The cutter knife according to claim 1, wherein said cutter knife and balancing disk are adjustable in their position relative to one another.

4. The cutter knife according to claim 3, wherein at least one slotted hole is provided in one of said cutter knife and said balancing disk, through which slotted hole extends a screw which is secured in the other of said balancing disk and said cutter knife.

5. The cutter knife according to claim 1, wherein a balancing disk is mounted on each side of said cutter knife.

6. The cutter knife according to claim 5, wherein said balancing disk is provided with said dynamic balancing means which comprises plural holes into which pins which serve as balancing weights are received.

7. The cutter knife according to claim 5, wherein said balancing disk is provided with several tapped holes, into which threaded pins which serve as balancing weights can be screwed.

8. The cutter knife according to claim 7, wherein said tapped holes are arranged concentrically with respect to said opening for receiving said cutter spindle.

9. The cutter knife according to claim 1, wherein said stop key means is provided in said opening of said cutter knife with markings for making reworking easier.

10. In a cutter knife having a knife blade and a knife hub with an opening therethrough for receiving a cutter spindle therein, which opening is constructed in the shape of a polygon and having stop key means for said cutter spindle in the side of said opening which is opposite said knife blade, the improvement comprising wherein said knife hub is a heavy balancing part arranged approximately diametrically opposite with respect to said knife blade and the shape, position and weight of which are chosen such that the cutter knife is statically balanced by facilitating the orientation of the center of gravity of said cutter knife on the axis of said cutter spindle, said balancing part having plural holes therein arcuately spaced around at least a portion of said opening, at least one pin serving as a balancing weight received in a selected one of said holes to facilitate a dynamic balancing of said cutter knife on said cutter spindle.

11. The cutter knife according to claim 10, wherein said heavy balancing part has a greater thickness than the remainder of said cutter knife.

12. The cutter knife according to claim 11, wherein said holes are tapped holes, and wherein said pin is a threaded pin threadedly received in said hole.

* * * * *